United States Patent [19]

Nguyen

[11] Patent Number: 5,040,847

[45] Date of Patent: Aug. 20, 1991

[54] CHAIR AND METHOD FOR CONSTRUCTING A CHAIR

[76] Inventor: Chuong Q. B. Nguyen, 2522 Lance La., Stafford, Tex. 77477

[21] Appl. No.: 432,071

[22] Filed: Nov. 2, 1989

[51] Int. Cl.[5] ..... A47C 1/12

[52] U.S. Cl. ..... 297/447; 297/445

[58] Field of Search ..... 297/445, 447, 457

[56] References Cited

U.S. PATENT DOCUMENTS

| | | | |
|---|---|---|---|
| 2,439,690 | 4/1948 | Lippenberger | 297/447 X |
| 2,642,118 | 6/1953 | Lamb | 297/447 X |
| 2,649,147 | 8/1953 | Sanford | 297/447 X |
| 2,670,787 | 3/1954 | Vandas et al. | 297/447 X |
| 2,677,413 | 5/1954 | Pernecry, Jr. et al. | 297/447 X |
| 4,210,182 | 7/1980 | Danko | 297/447 X |

*Primary Examiner*—Peter A. Aschenbrenner
*Attorney, Agent, or Firm*—Arnold, White & Durkee

[57] ABSTRACT

A chair 11 is constructed from a generally rectangular, rigid sheet of material 12, such as plywood. A plurality of longitudinal cuts extend from a second end portion 24 toward a first end portion 26 of the sheet 12 to form a plurality of substantially similar longitudinal strips 28, which are separated at the first end portion 26 but remain connected at the second end portion of the sheet 12. The longitudinal strips 28 are divided into first and second portions 28*a*, 28*b*, such that no two adjacent strips 28 belong to the same portion 28*a*, 28*b*. The first end portion 24 is generally vertically disposed to form a front support structure 27. The first and second portions of longitudinal strips 28*a*, 28*b* are bent at an approximately 90 degree angle to form the seat 31. The first and second portions of longitudinal strips 28*a*, 28*b* are bent again in generally opposite directions to form a rear support structure 29 and a back support structure 30 respectively.

18 Claims, 3 Drawing Sheets

CHAIR AND METHOD FOR CONSTRUCTING A CHAIR

BACKGROUND OF THE INVENTION

1. Field of the Invention

This invention relates generally to furniture and a method for constructing furniture and, more particularly, to a chair and a method for constructing a chair from a single sheet of generally rigid material.

2. Description of the Related Art

In the field of furniture design and construction, the manufacturer is faced with the dilemma of whether to produce attractive and fashionable furniture or furniture that is simple and inexpensive to construct. Quite often, these two design constraints are mutually exclusive. In other words, it is common for furniture that is relatively simple in design and construction to be less than pleasing aesthetically. On the other hand, furniture that is widely recognized for its uniqueness and beauty is often difficult and expensive to manufacture.

The common chair is a good example of a piece of furniture that appears deceptively simple to manufacture. The chair serves the relatively simple function of providing an elevated platform on which to sit with a backrest for additional comfort.

However, construction of the chair commonly involves the use of numerous sophisticated power tools, as well as skilled craftsman to operate them. For example, in the construction of an ordinary chair, an expensive, high-quality lathe is commonly required to produce the legs of the chair, as well as any spindles appearing in the backrest of the chair. Additionally, expensive band saws or equally sophisticated industrial equipment are commonly used to cut the intricate curved surfaces associated with the seat and backrest. Moreover, once the actual construction of the common chair is complete, the finishing process requires considerable time and attention from skilled artisans to ensure that the final product is satisfactory.

It should be appreciated that as the chair design becomes more complex, the number of parts required for assembly increases, the difficulty of assembling the parts increases, and the reliability and life expectancy of the chair decreases. Clearly, the greater the number of parts and steps necessary to assemble the parts, the greater the likelihood that one of these parts will fail or one of the steps will be inadequately performed.

Accordingly, the present chair and method for assembling the chair are directed to overcoming one or more of the above-identified problems.

SUMMARY OF THE INVENTION

The primary object of the present invention is to provide a chair that is simple and inexpensive in design and construction, but aesthetically pleasing.

To attain these and other objectives, a chair is provided that is constructed from a sheet of generally rectangular, rigid material. The sheet of material has a first end portion adapted to form a front support structure, a second end portion adapted to form a rear support structure and a generally upright back support structure, and an intermediate portion adapted to form a seat. The first end portion is generally vertically arranged, the intermediate portion is generally horizontally arranged, and the second end portion is bifurcated into a plurality of longitudinal strips, wherein a first portion of the plurality of longitudinal strips are bent downwardly from the intermediate portion to form the rear support structure, and a second portion of the longitudinal strips are bent upwardly from the intermediate portion to form the back support structure.

In another aspect of the present invention, a method is provided for constructing a chair from a sheet of generally rectangular, rigid material. The method includes the steps of making a plurality of longitudinal cuts extending from a second end portion of the sheet of material toward a first end portion of the sheet of material to form a plurality longitudinal strips. The longitudinal strips are separated at their second end portion and connected together at their first end portion. The method further includes the steps of bending the sheet of material adjacent the first end portion transverse with the longitudinal axis to form an angle of intersection in the range of 90 to 45 degrees between the first end portion and an intermediate portion of the sheet of material, whereby the first end portion forms a front support structure and the intermediate portion forms a seat. A first and second portion of the longitudinal strips are selected. The method includes the step of bending the first portion of the longitudinal strips in a direction toward the first end portion to form an angle of intersection in the range of 135 to 45 degrees between the first portion of longitudinal strips and the intermediate portion of the sheet of material, whereby the first portion of longitudinal strips forms a rear support structure. Finally, the method includes the step of bending the second portion of the longitudinal strips in a direction away from the first end portion to form an angle of intersection in the range of 90 to 135 degrees between the second portion of longitudinal strips and the intermediate portion of the sheet of material, whereby the second portion of longitudinal strips form a back support structure.

BRIEF DESCRIPTION OF THE DRAWINGS

Other objects and advantages of the invention will become apparent upon reading the following detailed description and upon reference to the drawings in which.

Figure 1:
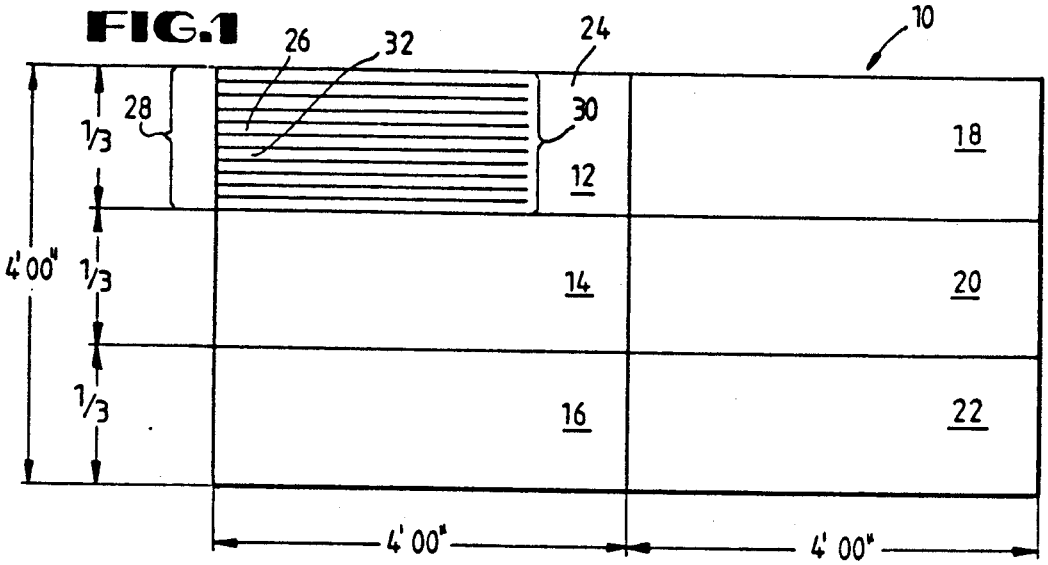
FIG. 1 is a top view of a generally rectangular, rigid sheet of material used as the starting raw material to construct a plurality of chairs.

While the invention is susceptible to various modifications and alternative forms, specific embodiments thereof have been shown by way of example in the drawings and are herein described in detail. It should be understood, however, that the intent is not to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENT

Figure 3:
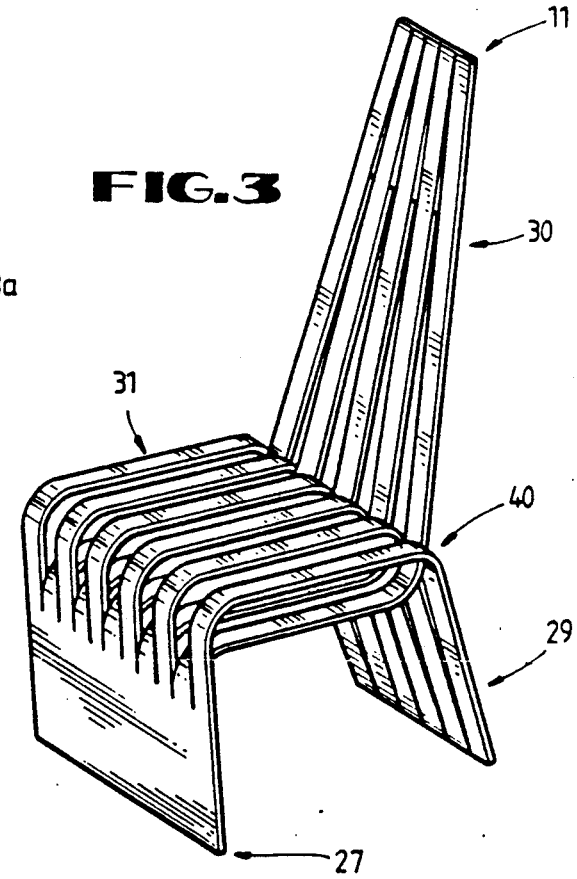
FIG. 3 is a perspective view of a constructed chair.

FIG. 1 illustrates a top view of a generally rectangular, rigid sheet of material 10 used as the starting raw material to construct a plurality of chairs, such as the chair 11 illustrated in FIG. 3. The illustrated sheet of material 10 is a 4'×8' sheet of, for example, plywood divided into six smaller sheets 12, 14, 16, 18, 20, 22. Each of these sheets of material 12, 14, 16, 18, 20, 22 are sufficient in size to be used in constructing a chair of the design illustrated herein.

To simplify the discussion of the design and construction of the chair, reference to the material 10 will ordinarily be limited to plywood. However, those skilled in the field of furniture design recognize that numerous other types of material are readily substitutable without departing from the spirit and scope of the instant invention. For example, the material 10 could readily take the form of plastic, metal, other types of wood, or any other sufficiently rigid material. As will become apparent through a reading of the specification, the type of material employed will only result in slight modifications to the method of construction employed to bend and join the material.

Returning now to a discussion of FIG. 1, each of the sheets 12, 14, 16, 18, 20, 22 has the approximate dimensions of 16" wide and 48" long. Each of the sheets 12, 14, 16, 18, 20, 22 is substantially identical, as is the method for constructing the chair 11 therefrom. Accordingly, the following discussion is limited to the first of these sheets 12 with the understanding that construction of similar chairs from the remaining sheets of material 14, 16, 18, 20, 22 is substantially identical.

The first sheet 12 is separated from the remainder of the sheets of material 10 by a cutting process, such as sawing. A first end portion 24 of the sheet 12 remains substantially in its unprocessed form and is used to construct a front support structure 27 of the chair 11 (see FIG. 3). A second end portion 26 of the sheet 12 is bifurcated into a plurality of longitudinal strips 28. Preferably, the longitudinal strips 28 extend from the second end portion 26 in a direction toward the first end portion 24 so that the first end portions 30 of the longitudinal strips 28 remain connected together while the second end portions 32 of the longitudinal strips 28 are separated. Preferably, there are eleven longitudinal strips 28 with each individual strip being approximately 1.5" wide.

Figure 2:
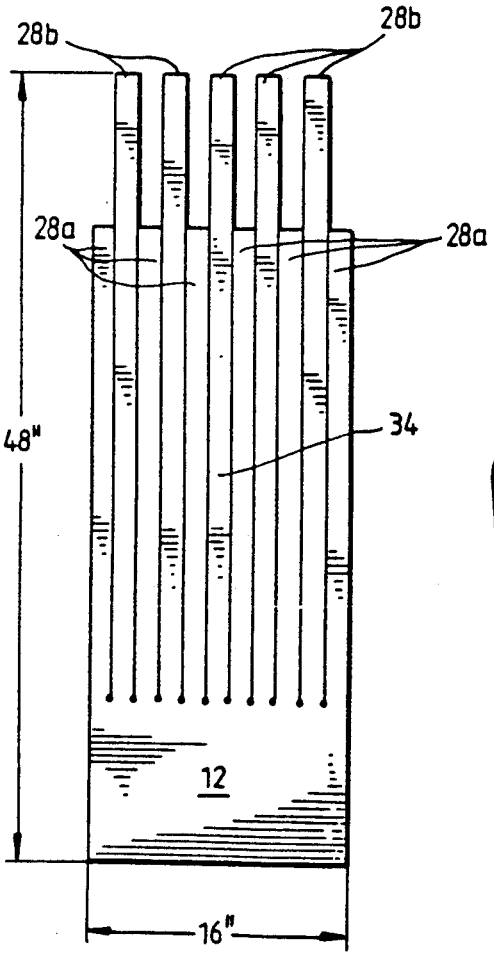
FIG. 2 is a top view of a generally rectangular, rigid sheet of material used to construct a single chair with all of the necessary cuts illustrated.

Referring now to FIG. 2, a top view of the sheet 12 with all the necessary outs for constructing the chair 11 is illustrated. The longitudinal strips 28 are divided into a first portion **28*a* and the second portion 28*b* wherein the first portion of longitudinal strips 28*a* are selected from the group of every other one of the longitudinal strips 28 and the second portion of longitudinal strips 28*b* are selected from the remaining longitudinal strips 28. Thus, any two longitudinal strips 28 are in different portions of the longitudinal strips 28*a*, 28*b*. In other words, every other longitudinal strip 28 is in the first portion 28*a* while the remaining strips 28 are in the second portion 28*b*. This division of longitudinal strips 28 into the first and second portions 28*a*, 28*b* is significant in that the first portion of longitudinal strips 28*a* forms a rear support structure 29 of the chair and the second portion of longitudinal strips 28*b* forms the backrest or back support structure 30 of the chair 11 (see FIG. 3**).

In the preferred embodiment, the first portion of longitudinal strips **28*a* are slightly shorter than the second portion of longitudinal strips 28*b*. Upon further reading of this specification, it will become clear that the ratio of the chair front and rear support structure and the depth of the seat portion dictate the length of the first portion of longitudinal strips 28*a*. In other words, to obtain a seat portion 31 of the chair 11 that is located at the proper height and has the proper dimension from the front to rear support structures 27, 29, the first portion of longitudinal strips 28*a*** should be designed to the appropriate length.

On the other hand, the length of the second portion of longitudinal strips **28*b* is generally only important for aesthetic design purposes. The length of the second portion of longitudinal strips 28*b* controls the height of the backrest 30 of the chair 11. Thus, it may be desirable to have a backrest height that balances the overall aesthetic design of the chair 11**.

The process for constructing the chair 11 from the sheet 12 includes a step of bending the sheet 12 adjacent the first end portion 24 transverse with the longitudinal axis of the sheet 12 to form an angle of intersection in the range of 135 to 45 degrees between the first end portion 24 and an intermediate portion 34 of the sheet 12. This bending process forms the front support structure 27 from the first end portion 24 and the seat 31 from the intermediate portion 34.

A steaming process is used to bend the sheet 12 where the sheet 12 is a type of wood product, such as plywood. This steaming process is well known in the field of furniture design and is applied to the wood-product sheet 12, as is standard throughout the furniture manufacturing industry. On the other hand, where the sheet 12 takes the form of an organic plastic, the bending process employs localized heating to render the sheet 12 flexible at the region to be bent. Similarly, where the sheet 12 takes the form of a metal product, localized heating may also be employed. Further, selective forging and stamping processes may also be used to effect the bending process. Numerous other bending processes are envisioned that do not depart from the spirit and scope of the invention.

The front support structure 27 is preferably generally vertically arranged, however, deviations from vertical are, of course, within the spirit and scope of the invention and may be desirable to establish an overall aesthetic pleasing value of the chair 11. The important aspect of the front support structure 27 is that it properly supports the front of the chair 11 in a generally upright manner.

The intermediate portion 34 of the sheet 12 forms the seat 31 of the chair 11 and is, therefore, generally horizontally arranged when the chair 11 is arranged in its normal, useful position. Once again, deviations from horizontal are within the spirit and scope of the invention. The important aspect of the seat 31 is that it properly supports a person seated in the chair 11.

Figure 5:
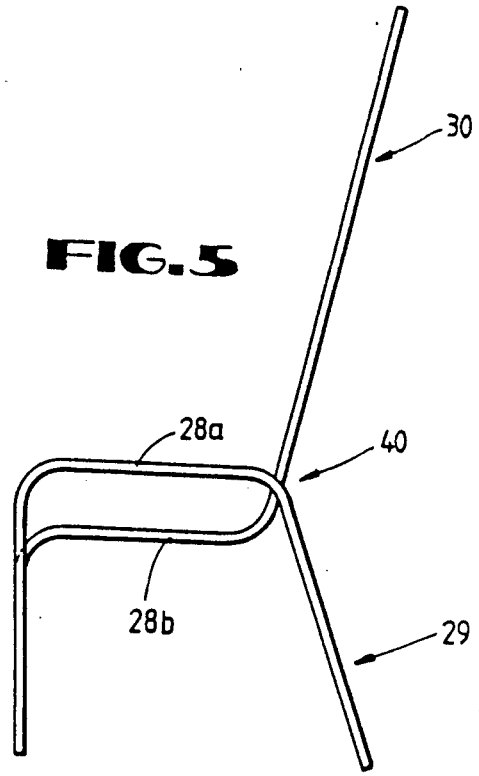
FIG. 5 is a left side view of a constructed chair.

The actual seat 31 is, however, formed from only the first portion of longitudinal strips **28*a*. The first portion of longitudinal strips 28*a* are bent at a first preselected distance from the first end portion 24 of the sheet 12. Likewise, the second portion of longitudinal strips 28*b* are bent at a second preselected distance from the first end portion 24 of the sheet 12. For the first portion of longitudinal strips 28*a* to form the actual seat 31 of the chair 11, the first preselected distance is greater than the second preselected distance. This feature is more clearly seen in FIG. 5 where a side view of the constructed chair 11 is illustrated. Here, it can be clearly seen that the first portion of longitudinal strips 28***a* are disposed a vertical distance above the second portion of longitudinal strips 28*b*.

To form the rear support structure 29 of the chair 11, the first portion of longitudinal strips 28*a* are again bent, using the above described bending process, in a direction toward the first end portion 24 to form an angle of intersection in the range of 90 to 35 degrees between the first portion of longitudinal strips 28*a* and the intermediate portion 34 of the sheet 12.

Similarly, the second portion of longitudinal strips 28*b* are bent in a direction away from the first end portion 24 to form an angle of intersection in the range of 90 to 135 degrees between the second portion of longitudinal strips 28*b* and the intermediate portion 34 of the sheet 12. In this manner, the second portion of longitudinal strips 28*b* form the back support structure 30.

The first and second portions of longitudinal strips 28*a*, 28*b* intersect with one another in the region 40. That is to say, the first and second portions of longitudinal strips 28*a*, 28*b* are interposed between one another and are not positively connected at the region 40, but are frictionally held together. This frictional fit allows for movement between the first and second portions of longitudinal strips 28*a*, 28*b* so as to provide a springing action to the backrest 30 and seat 31.

The second end portions 32 of the first and second portions of longitudinal strips 28*a*, 28*b* are joined together to complete construction of the chair 11. Preferably, the second end portions 32 of longitudinal strips 28, 28*b* are permanently joined together by such methods as gluing, nailing, screwing, pinning, welding, soldering, etc.

Figure 4:
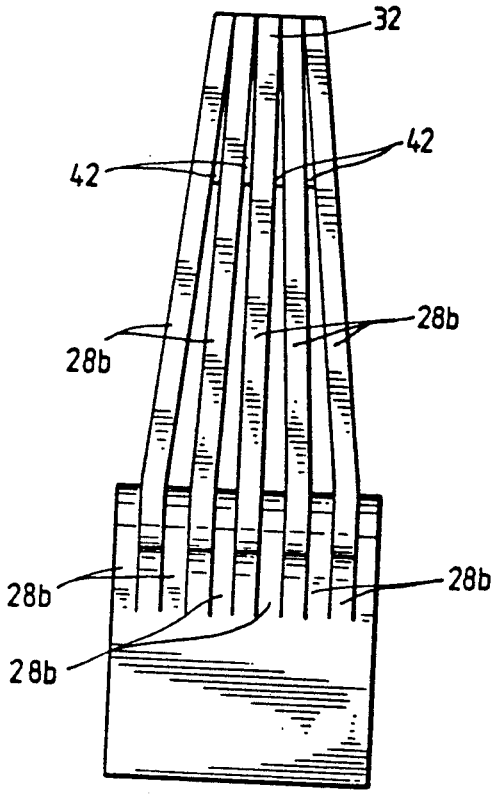
FIG. 4 is a front view of a constructed chair.

It should be appreciated, however, and is best shown in the frontal view of FIG. 4, that since the second portion of longitudinal strips 28*b* are connected together to form a width approximately one half of the original width of the sheet 12, triangular spaces 42 remain between the first end portions 32 of the longitudinal strips 28*b*. Accordingly, to provide a strong and complete connection between the second portion of longitudinal strips 28*b*, appropriately shaped triangular pieces of plywood are disposed in these triangular spaces 42. These triangular pieces of plywood are readily obtained from scrap plywood. It should be appreciated that similar triangular spaces remain when the first portion of longitudinal strips 28*a* are joined together to form the rear support structure 29. Accordingly, additional triangular strips are cut from the scrap plywood to fill the triangular spaces remaining in the rear support structure 29, substantially identical to the spaces 42.

Figure 6:
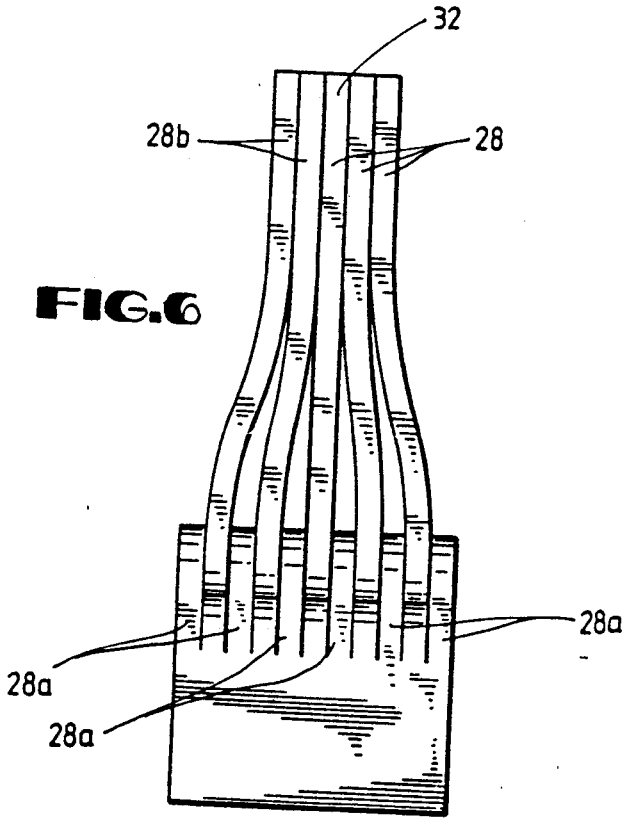
FIG. 6 is a front view of an alternative embodiment of a constructed chair.

Alternatively, the triangular spaces 42 are removed by appropriate bending of the second end portions 32 of the second portion of longitudinal strips 28*b*. As shown in FIG. 6, the second portion of longitudinal strips 28*b* are bent inwardly toward the longitudinal axis of the backrest 30 to form the longitudinal strips 28*b* into generally parallel and immediately adjacent strips that may be easily joined together through any of the above-identified processes.

Figure 7:
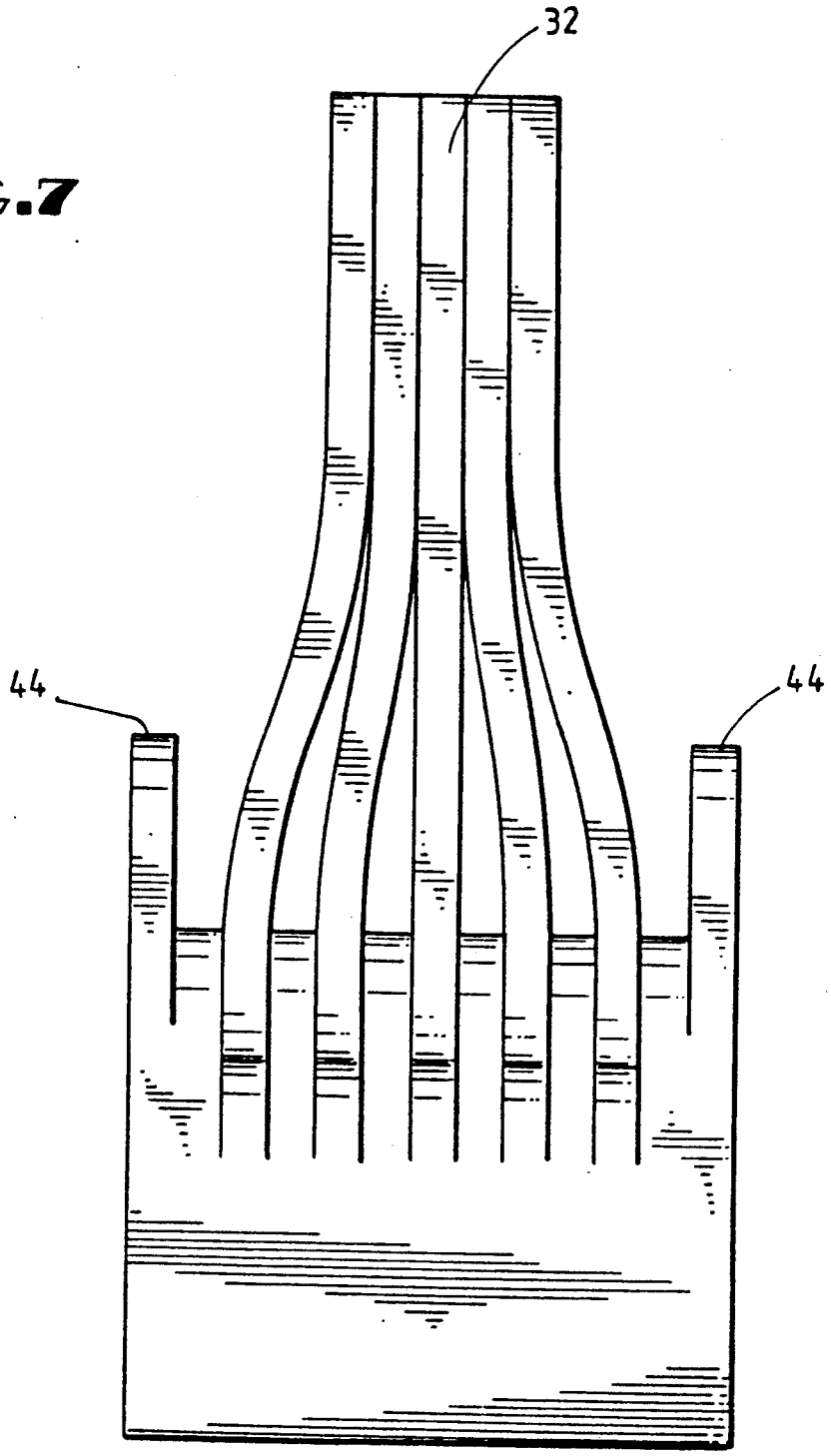
FIG. 7 is a front view of an alternative embodiment of a constructed chair.

Referring now to FIG. 7, an alternative embodiment of the chair 11 is illustrated. In this embodiment, armrests 44 are shown formed from additional longitudinal strips 28 positioned on opposite sides of the sheet 12. Preferably, the armrests 44 are formed substantially identical to the first and second portions of longitudinal strips 28*a*, 28*b* but are simply bent at a substantially greater vertical height.

To properly form the chair illustrated in this embodiment, the sheets of material 12, 14, 16, 18, 20, 22 should be approximately 3 inches wider so as to form rectangular sheets of material that are approximately 19″×48″. Therefore, constructing chairs with the illustrated armrests 44 results in the 4′×8′ sheet of material 10 only producing 4 complete chairs, rather than the 6 armless chairs illustrated in FIGS. 1 through 6.

I claim:

1. A chair constructed from a sheet of generally rectangular, rigid material, comprising:

said sheet of material having a first end portion adapted to form a front support structure, a second end portion adapted to form a rear support structure and a generally upright back support structure, and an intermediate portion adapted to form a seat;

said first end portion being generally vertically arranged;

said intermediate portion being generally horizontally arranged; and said second end portion being bifurcated into a plurality of longitudinal strips, a first portion of said longitudinal strips being bent downwardly from said intermediate portion thereby forming said rear support structure, and a second portion of said plurality of longitudinal strips being bent upwardly from said intermediate portion thereby forming said back support structure.

2. A chair, as set forth in claim 1, wherein said first portion of longitudinal strips are connected together adjacent said second end portion.

3. A chair, as set forth in claim 1, wherein said second portion of longitudinal strips are connected together adjacent said second end portion.

4. A chair, as set forth in claim 1, wherein said intermediate portion is bifurcated into a plurality of longitudinal strips coextensive with said second end portion longitudinal strips.

5. A chair, as set forth in claim 4, wherein said first portion of longitudinal strips extend from said first end portion at a first preselected height and said second portion of longitudinal strips extend from said first end portion at a second preselected height differing from said first preselected height.

6. A chair, as set forth in claim 5, wherein said first preselected vertical height is greater than said second preselected vertical height.

7. A chair, as set forth in claim 1, wherein said first portion of longitudinal strips are selected from the group of every other one of said longitudinal strips and the second portion of longitudinal strips are selected from the remaining longitudinal strips whereby any two adjacent longitudinal strips are in different portions of the longitudinal strips.

8. A chair constructed from a sheet of generally rectangular, rigid material, comprising:

said sheet of material having a first end portion adapted to form a front support structure, a second end portion adapted to form a rear support structure and a generally upright back support structure, and an intermediate portion adapted to form a seat;

said first end portion being generally vertically arranged;

said intermediate portion being generally horizontally arranged and bifurcated into a plurality of longitudinal strips extending from said first end portion, a first portion of said longitudinal strips extending from said first end portion at a first preselected height and a second portion of said longitudinal strips extending from said first end portion at a second preselected height differing from said first preselected height; and said second end portion being bifurcated into a plurality of longitudinal strips coextensive with said intermediate portion longitudinal strips, said first portion of said longitudinal strips being bent downwardly from said intermediate portion thereby forming said rear support structure, said second portion of said plurality of longitudinal strips being bent upwardly from said intermediate portion thereby forming said back support structure.

9. A chair, as set forth in claim 8, wherein said first preselected vertical height is greater than said second preselected vertical height.

10. A chair, as set forth in claim 8, wherein said first portion of longitudinal strips are connected together adjacent said second end portion.

11. A chair, as set forth in claim 8, wherein said second portion of longitudinal strips are connected together adjacent said second end portion.

12. A chair, as set forth in claim 8, wherein said first portion of longitudinal strips are selected from the group of every other one of said longitudinal strips and the second portion of longitudinal strips are selected from the remaining longitudinal strips whereby any two adjacent longitudinal strips are in different portions of the longitudinal strips.

13. A method for constructing a chair from a sheet of generally rectangular, rigid material, comprising the steps of:

making a plurality of longitudinal cuts extending from a second end portion of said sheet of material toward a first end portion of said sheet of material to form a plurality longitudinal strips being separated at their second end portion and connected at their first end portion;

bending said sheet of material adjacent said first end portion transverse with said longitudinal axis to form an angle of intersection in the range of 135 to 45 degrees between said first end portion and an intermediate portion of said sheet of material, whereby said first end portion forms a front support structure and said intermediate portion forms a seat;

selecting a first and second portion of said longitudinal strips;

bending said first portion of said longitudinal strips in a direction toward said first end portion to form an angle of intersection in the range of 135 to 45 degrees between said second portion of longitudinal strips and said intermediate portion of said sheet of material, whereby said first portion of longitudinal strips forms a rear support structure; and bending said second portion of said longitudinal strips in a direction away from said first end portion to form an angle of intersection in the range of 90 to 135 degrees between said second portion of longitudinal strips and said intermediate portion of said sheet of material, whereby said second portion of longitudinal strips form a back support structure.

14. A method, as set forth in claim 13, wherein said step of making a plurality of longitudinal cuts includes extending said cuts from said second end portion of said sheet of material through said intermediate portion of said sheet of material to form a plurality of intermediate longitudinal strips coextensive with said second end portion longitudinal strips.

15. A method, as set forth in claim 14, wherein said step of bending said sheet of material adjacent said first end portion includes bending said first portion of said longitudinal strips at a first preselected distance from said first end portion of said sheet of material and bending said second portion of said longitudinal strips at a second preselected distance from said first end portion of said sheet of material to form an angle of intersection in the range of 135 to 45 degrees between said first end portion and said first and second portions of longitudinal strips, said first preselected distance being greater than said second preselected distance whereby the second portion of said longitudinal strips form said seat.

16. A method, as set forth in claim 13, wherein said step of selecting a first and second portion of said longitudinal strips includes selecting said first portion of longitudinal strips from the group of every other one of said longitudinal strips and selecting the second portion of longitudinal strips from the remaining longitudinal strips whereby any two adjacent longitudinal strips are in different selected portions of the longitudinal strips.

17. A method, as set forth in claim 13, including the step of connecting together the second end portion of said first portion of longitudinal strips.

18. A method, as set forth in claim 13, including the step of connecting together the second end portion of said second portion of longitudinal strips.

* * * * *